US009914503B2

(12) United States Patent
Huyge et al.

(10) Patent No.: US 9,914,503 B2
(45) Date of Patent: Mar. 13, 2018

(54) BOAT HAVING AN IMPROVED ABILITY TO GET ON PLANE AND IMPROVED METHOD OF GETTING A BOAT ON PLANE

(71) Applicant: MasterCraft Boat Company, LLC, Vonore, TN (US)

(72) Inventors: Matthew J. Huyge, Wyoming, MI (US); Michael D. Myers, Knoxville, TN (US); Darren S. Sheedy, Greenback, TN (US); David F. Ekern, Knoxville, TN (US)

(73) Assignee: MasterCraft Boat Company LLC, Vonore, TN (US)

( * ) Notice: Subject to any disclaimer, the term of this patent is extended or adjusted under 35 U.S.C. 154(b) by 108 days.

(21) Appl. No.: 15/004,050

(22) Filed: Jan. 22, 2016

(65) Prior Publication Data

US 2016/0214681 A1 Jul. 28, 2016

Related U.S. Application Data

(60) Provisional application No. 62/106,330, filed on Jan. 22, 2015.

(51) Int. Cl.
*B63B 1/22* (2006.01)
*B63B 1/28* (2006.01)
(Continued)

(52) U.S. Cl.
CPC ..... *B63B 1/22* (2013.01); *B63B 1/286* (2013.01); *B63B 1/32* (2013.01); *B63B 39/061* (2013.01); *B63B 9/08* (2013.01); *B63B 2035/855* (2013.01)

(58) Field of Classification Search
CPC .... B63J 2099/006; B63B 1/20; B63B 39/061; B63B 1/28; B63B 1/286; B63B 1/22;
(Continued)

(56) References Cited

U.S. PATENT DOCUMENTS 5,263,432 A 11/1993 Davis
5,385,110 A * 1/1995 Bennett ..... B63B 39/061 114/285
(Continued)

OTHER PUBLICATIONS

Helm Master Operation Manual, U.S.A. Edition, LIT-18626-10-03, Yamaha, Dec. 2012, (available at http://yamahaoutboards.com/owner-resources/owners-manuals (select 2006 or later, select Helm Master) (last visited Jan. 21, 2016)).
(Continued)

*Primary Examiner* — Lars A Olson
(74) *Attorney, Agent, or Firm* — Fitzpatrick, Cella, Harper & Scinto

(57) ABSTRACT

A boat includes at least three trim devices positioned aft of the boat's transom. To improve the boat's ability to get on place, each trim device is initially positioned to a deployed position. The speed of the boat is then determined as the boat gains speed. When the speed of the boat exceeds a first predetermined threshold, the first trim device is moved from the deployed position to a non-deployed position. When the speed of the boat exceeds a second predetermined threshold, the second trim device is moved from the deployed position to a non-deployed position. When the speed of the boat exceeds a third predetermined threshold, the third trim device is moved from the deployed position to a non-deployed position. At least one of the first, second, and third predetermined thresholds is different from the other two of the first, second, and third predetermined thresholds.

41 Claims, 7 Drawing Sheets

(51) Int. Cl.

| | |
|---|---|
| ***B63B 1/32*** | (2006.01) |
| ***B63B 39/06*** | (2006.01) |
| *B63B 9/08* | (2006.01) |
| *B63B 35/85* | (2006.01) |

(58) Field of Classification Search
CPC ..... B63B 1/32; B63B 35/73; B63B 35/85; B63B 2035/855
USPC ..... 114/284, 285
See application file for complete search history.

(56) References Cited

U.S. PATENT DOCUMENTS

| | | | |
|---|---|---|---|
| 6,874,441 | B2 | 4/2005 | Pigeon |
| 7,140,318 | B1 | 11/2006 | Gasper |
| 7,311,058 | B1 | 12/2007 | Brooks et al. |
| 7,318,389 | B2 | 1/2008 | Boning |
| 7,434,531 | B1 | 10/2008 | Zsido et al. |
| 8,100,079 | B2 | 1/2012 | Buzzi |
| 8,376,793 | B2 * | 2/2013 | Chiecchi ..... B63B 39/061 440/53 |
| 8,534,214 | B1 | 9/2013 | Gasper |
| 8,539,897 | B1 | 9/2013 | Gasper et al. |
| 8,578,873 | B2 | 11/2013 | Gasper et al. |
| 8,622,012 | B2 | 1/2014 | Olofsson |
| 8,833,286 | B1 | 9/2014 | Sheedy et al. |
| 9,067,644 | B2 | 6/2015 | Sheedy et al. |
| 9,174,703 | B2 | 11/2015 | Sheedy et al. |
| 9,669,903 | B2 | 6/2017 | Gasper et al. |
| 2011/0126751 | A1 | 6/2011 | Muller |
| 2015/0175242 | A1 | 6/2015 | Sheedy et al. |
| 2016/0039501 | A1 | 2/2016 | Sheedy et al. |

OTHER PUBLICATIONS

Auto Glide Boat Control System Owner's Manual A: Installation & Setup Procedures, Lenco Marine Inc., Mar. 10, 2011 (available at http://www.lencoautoglide.com/ (click Owners Manual) (last visited Jan. 21, 2016)).

Auto Glide Boat Control System Owner's Manual B: Operational Instructions, Lenco Marine Inc., Mar. 11, 2011 available at http://www.lencoautoglide.com/ (click Owners Manual) (last visited Jan. 21, 2016)).

Sheedy et al., co-pending U.S. Appl. No. 14/951,638, filed Nov. 25, 2016.

* cited by examiner

BOAT HAVING AN IMPROVED ABILITY TO GET ON PLANE AND IMPROVED METHOD OF GETTING A BOAT ON PLANE

CROSS REFERENCE TO RELATED APPLICATION

This application claims the benefit under 35 U.S.C. § 119(e) of U.S. Provisional Patent Application No. 62/106,330, filed Jan. 22, 2015, and titled "Boat and a Method of Operating a Boat with an Improved Ability to Plane," the entirety of which is incorporated herein by reference.

FIELD OF THE INVENTION

This invention relates to a boat and a method of operating a boat, particularly a boat having an improved ability to get on plane and an improved method of getting a boat on plane.

BACKGROUND OF THE INVENTION

Many recreational boats have planing hulls. When these boats reach a certain speed, the resistance of the hull dramatically drops as the boat is supported by hydrodynamic forces instead of hydrostatic (buoyant) forces. This is referred to as planing.

Boats used for wakeboarding and wake surfing frequently have a larger displacement compared to other recreational boats. Often wakeboarding and wake surfing boats have ballast tanks or bags positioned throughout the boat that may be filled to even further increase the displacement of the boat. This is used to create a larger wake for wakeboarding and wake surfing. However, the increased amount of weight, especially in the stern, creates a steep running angle of attack, which, among other things, reduces helm visibility, and increases the amount of resistance produced by the hull as the boat moves through the water. As a result, such boats may have difficultly getting on plane or may require very powerful motors in order to get on plane.

Some boats have overcome these difficulties by utilizing trim devices attached to the transom of the boat. For example, MasterCraft Boat Company of Vonore, Tenn., introduced an Auto Launch feature on their 2012 model year boats, which was replaced by a revised Auto Launch feature on their 2013 model year boats. The 2012 and 2013 model year boats both had three trim tabs attached to the transom of the boat, a center tab, a port tab, and a starboard tab such as shown in FIG. 2 below. The 2012 model year boats used profiles for a particular water sport and/or a performer. These profiles included a desired speed at which the boat would cruise while the performer is being towed. For example, if a wakeboarder wanted to wakeboard at 22 miles per hour (mph), this would be set as the desired cruise speed. The three tabs were deployed, and then as the boat accelerated to the desired cruise speed for the selected profile, all three tabs were retracted simultaneously when the speed of the boat reached approximately one half of the desired cruise speed,. In the 2013 model year boats, the center tab would be deployed, and then as the boat accelerated to get on plane, the center tab would be automatically retracted when the boat reached a set speed designated between 15 mph and 20 mph. The 2013 Auto Launch feature used only the center tab and did not utilize the port and starboard tabs, which remained retracted.

SUMMARY OF THE INVENTION

In one aspect, the invention relates to a boat including a hull having a bow, a transom, and port and starboard sides.

The boat also includes at least three trim devices positioned aft of the transom. A first one of the trim devices is provided on a port side of the boat's centerline. A second one of the trim devices is provided on a starboard side of the boat's centerline. A third one of the trim devices is provided between the first and second trim devices. Each of the trim devices is moveable between a deployed position and a non-deployed position. The boat further includes a plurality of drive mechanisms, a speed sensing device, and a controller. Each drive mechanism is configured to move a corresponding trim device between the deployed position and the non-deployed position. The speed sensing device is configured to determine the speed of the boat. The controller is configured to actuate the drive mechanisms to move the trim devices to the deployed position and receive the speed of the boat from the speed sensing device. The controller is also configured to determine when the speed of the boat exceeds a first predetermined threshold and actuate the drive mechanism corresponding to the first trim device to move the first trim device from the deployed position to the non-deployed position when the speed of the boat exceeds the first predetermined threshold. The controller is further configured to determine when the speed of the boat exceeds a second predetermined threshold and actuate the drive mechanism corresponding to the second trim device to move the second trim device from the deployed position to the non-deployed position when the speed of the boat exceeds the second predetermined threshold. In addition, the controller is configured to determine when the speed of the boat exceeds a third predetermined threshold and actuate the drive mechanism corresponding to the third trim device to move the third trim device from the deployed position to the non-deployed position when the speed of the boat exceeds the third predetermined threshold. At least one of the first, second, and third predetermined thresholds is different from the other two of the first, second, and third predetermined thresholds.

In another aspect, the invention relates to a method of operating a boat. The method includes deploying each of at least three trim devices to a deployed position. A first one of the trim devices is provided on a port side of the boat's centerline. A second one of the trim devices is provided on a starboard side of the boat's centerline. A third one of the trim devices is provided between the first and second trim devices. The method also includes determining the speed of the boat, moving the first trim device from the deployed position to a non-deployed position when the speed of the boat exceeds a first predetermined threshold, moving the second trim device from the deployed position to a non-deployed position when the speed of the boat exceeds a second predetermined threshold, and moving the third trim device from the deployed position to a non-deployed position when the speed of the boat exceeds a third predetermined threshold. At least one of the first, second, and third predetermined thresholds is different from the other two of the first, second, and third predetermined thresholds.

In a further another aspect, the invention relates to a non-transitory computer readable storage medium having stored thereon sequences of instruction for executing the above-described method of operating a boat.

In some instances, the first predetermined threshold and the second predetermined threshold may be the same. Also in some instances, the third predetermined threshold may be greater than the first and second predetermined thresholds or less than the first and second predetermined thresholds. Each of the first, second, and third predetermined thresholds may preferably be between about 14 miles per hour and about 22 mile per hour. The first and second first predetermined threshold may also preferably be between about 14 miles per hour and about 18 miles per hour. The third predetermined threshold may also preferably be between about 18 miles per hour and about 22 miles per hour.

The at least three trim devices may be trim tabs or interceptors. When they are trim tabs, each of the trim devices extends at a downward angle in the deployed position. The downward angle of at least one of the first, second, and third trim devices in the deployed position may be different than the downward angles of the other two of the first, second, and third trim devices in the deployed position. The downward angle of the third trim device in the deployed position may be larger than the downward angles of the first and second trim devices in the deployed position. The downward angle of the first trim device in the deployed position may be the same as the downward angle of the second trim device in the deployed position.

When the at least three trim devices are interceptors, each of the interceptors includes a blade that extends a distance below the hull in the deployed position. The distance that the blade of at least one of the first, second, and third trim devices extends below the hull in the deployed position may be different than the distance that the blades of the other two of the first, second, and third trim devices extend below the hull in the deployed position. The distance that the blade of the third trim device extends below the hull in the deployed position may be greater than the distance that the blades of the first and second trim devices extend below the hull in the deployed position. The distance that the blade of the first trim device extends below the hull in the deployed position may be the same as the distance that the blade of the second trim device extends below the hull in the deployed position.

The speed sensing device may include at least one of a global positioning system receiver, a paddle wheel, and a pitot tube. The plurality of drive mechanisms may be linear actuators, hydraulic actuators, gas assist pneumatic actuators, electric motors, or other known drive mechanisms.

These and other aspects of the invention will become apparent from the following disclosure.

DETAILED DESCRIPTION OF THE PREFERRED EMBODIMENTS

The following description of a preferred embodiment of the invention will begin with a discussion of the boat in the first section, followed by a description of the control system of the boat in the second section. Then, the improved method of getting on plane will be described in the third section with reference to the features of the boat and control system. It will be appreciated that various aspects of this invention can be implemented using computer hardware, software, or a combination of both. Additional details of the computer implementation may be found in the fourth section below.

I. Recreational Sport Boat

Figure 1:
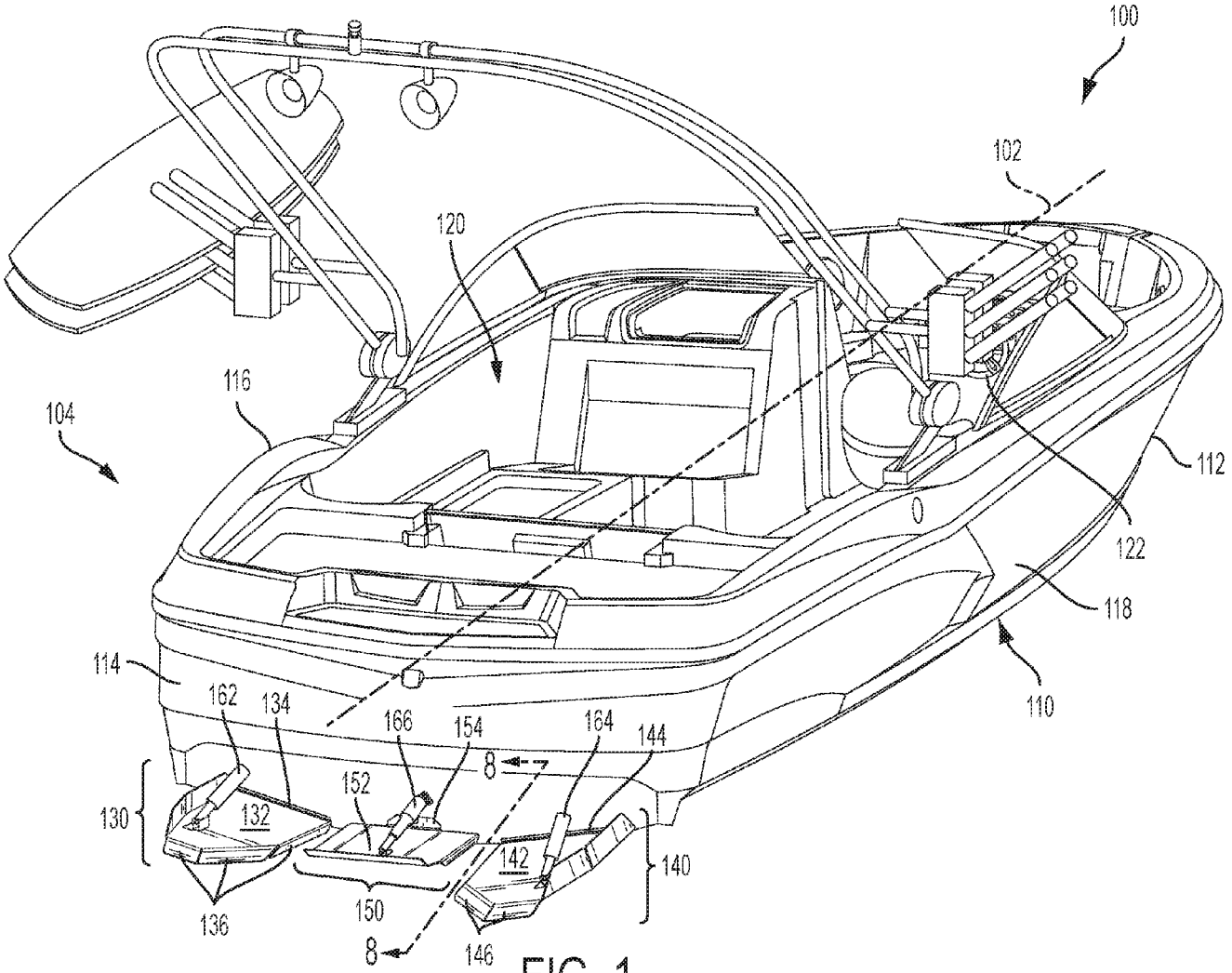
FIG. 1 shows a boat according to a preferred embodiment of the invention.

FIG. 1 shows a boat 100 in accordance with an exemplary preferred embodiment of the invention. The boat 100 includes a hull 110 with a bow 112, a transom 114, a port side 116, and a starboard side 118. Collectively, the bow 112, the transom 114, and the port and starboard sides 116, 118 define an interior 120 of the boat 100. Within the boat's interior 120 is a control console 122 for operating the boat 100. The boat 100 is driven by a single inboard motor (engine 450 in FIG. 4) connected to a propeller (not shown). However, this invention can be utilized with other types of boats and propulsion systems, including but not limited to outboard motors, sterndrives, and the like.

To improve its ability to get on plane, the boat 100 is equipped with at least three trim devices 130, 140, 150. Although this preferred embodiment shows a boat 100 with three trim devices 130, 140, 150, those of ordinary skill in the art will recognize how this invention may be implemented with more than three trim devices 130, 140, 150. The trim devices are located at the stern 104 of the boat 100, and in the embodiment shown in FIG. 1, the three trim devices 130, 140, 150 are attached to the transom 114. The first trim device 130 is provided on the port side of the centerline 102 of the boat 100; the second trim device 140 is provided on the starboard side of the centerline 102; and the third trim device 150 is provided between the first and second trim devices 130, 140, preferably along the centerline 102. The centerline 102 runs down the center of the boat 100, halfway between the port and starboard sides 116, 118.

In this embodiment, the first and second trim devices 130, 140 are, respectively, the port and starboard wake-modifying devices disclosed in U.S. Pat. No. 8,833,286, the entirety of which is incorporated herein by reference. Each of the first and second trim devices 130, 140 include a plate-like member 132, 142 that is pivotably attached to the transom 114 of the boat 100. The plate-like members 132, 142 pivot about pivot axes 134, 144 to move between a non-deployed position and a deployed position. In this embodiment, the pivot axes 134, 144 are hinges. Here, the hinges are piano hinges that are welded to a leading portion of each plate-like member 132, 142 and attached to the transom 114 of the boat 100 using screws. However, any suitable pivotable connection may be used and it may be affixed to the transom 114 of the boat 100 and the first and second trim devices 130, 140 using any suitable means, including but not limited to bolts, screws, rivets, welding, and epoxy. Each of the first and second trim devices 130, 140 also may include one or more downturned and/or upturned surfaces, such as downturned surfaces 136, 146, which are angled at a downward angle relative to the plate-like member 132, 142.

The third trim device 150 of the embodiment shown in FIG. 1 is a generally rectangular trim tab that is pivotably attached to the transom 114 of the boat 100. The third trim device 150 includes a plate-like member 152 and pivots about a pivot axis 154 to move between a non-deployed position and a deployed position. Like the pivot axes 134, 144 of the first and second trim devices 130, 140, the pivot axis 154 of the third trim device may be any suitable pivotable connection affixed to the transom 114 of the boat 100.

Each of the trim devices 130, 140, 150 is moveable between the deployed position and the non-deployed position by a drive mechanism 162, 164, 166. In the embodiment shown, a first drive mechanism 162 is used to move the first trim device 130, a second drive mechanism 164 is used to move the second trim device 140, and a third drive mechanism 166 is used to move the third trim device 150. Each of the drive mechanisms 162, 164, 166 is a linear actuator. The linear actuator preferably is an electric linear actuator, such as one available from Lenco Marine. One end of the linear actuator is connected to the transom 114 of the boat 100 and the other end is connected to the trim device 130, 140, 150. Any suitable means may be used to move the trim devices 130, 140, 150 between the deployed and non-deployed positions, including but not limited to hydraulic linear actuators, gas assist pneumatic actuators, and electrical motors.

The trim devices 130, 140, 150 may be attached to the transom 114 such that the pivot axes 134, 144, 154 are not flush with the transom 114, for example, the pivot axes 134, 144, 154 may be spaced further aft of the transom 114. The pivot axes 134, 144, 154 are preferably parallel to the transom 114, but they may be oriented at an oblique angle relative to the transom 114 so long as the trim devices 130, 140, 150 provide an upward force on the boat 100 as the boat 100 travels forward through the water.

Figure 6:
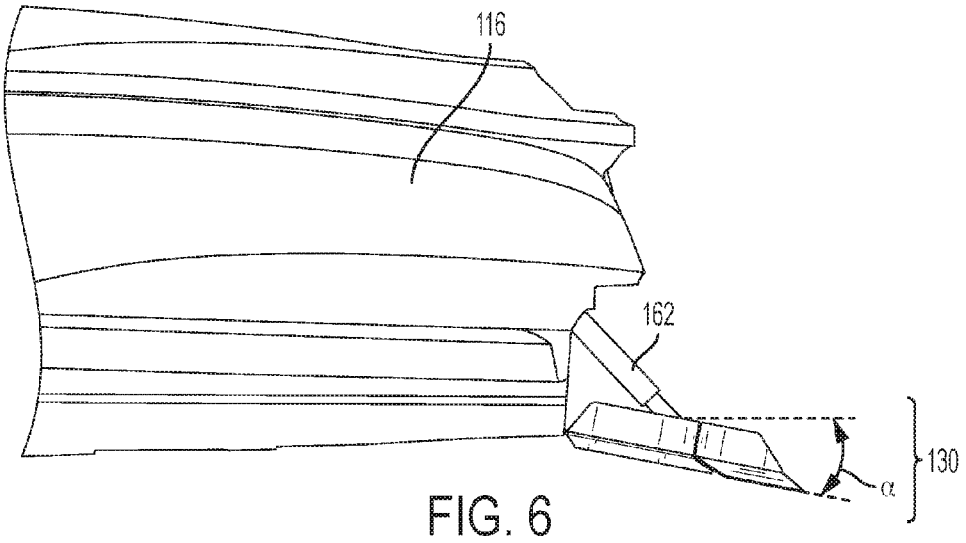
FIG. 6 is a port side view of the boat shown in FIG. 1 after step S510 in FIG. 5A.
Figure 7:
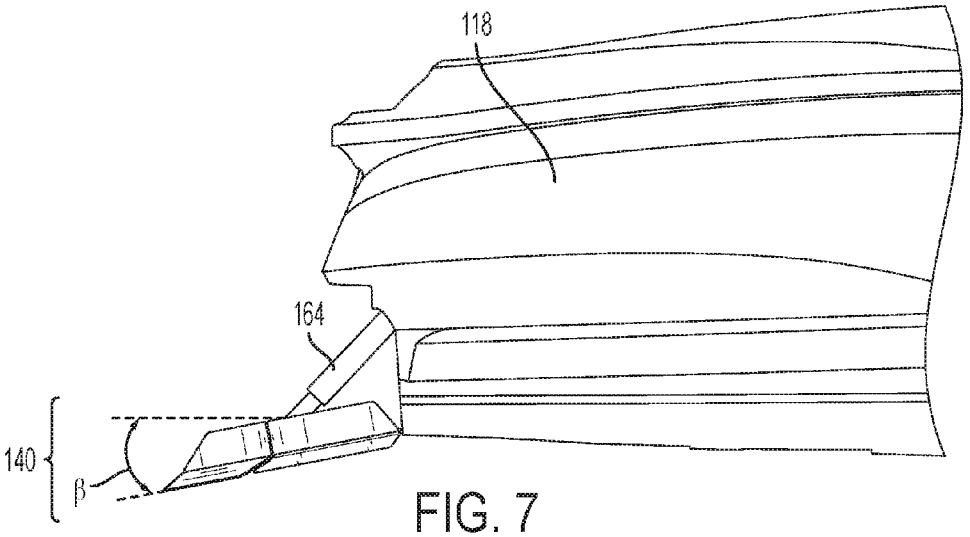
FIG. 7 is a starboard side view of the boat shown in FIG. 1 after step S510 in FIG. 5A.
Figure 8:
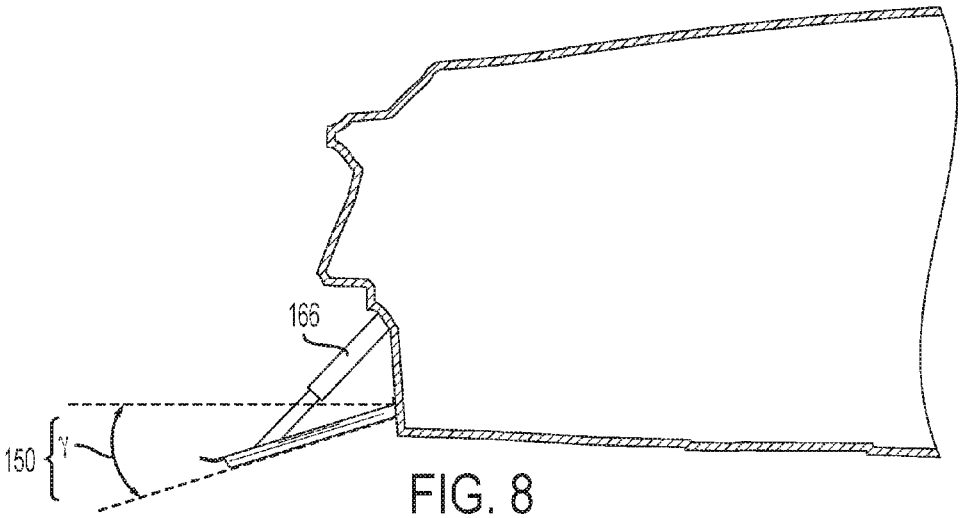
FIG. 8 is a cross-section view of the boat shown in FIG. 1 taken along section line 8-8 after step S510 in FIG. 5A.

In their deployed position, the trim devices 130, 140, 150 are configured to generate an upward force on the stern 104 of the boat 100. As shown in FIGS. 6-8, the trim devices 130, 140, 150 extend at a downward angle $\alpha$, $\beta$, $\gamma$, respectively, in their deployed positions. In their deployed positions, water impinges on the plate-like members 132, 142, 152 and the downturned surfaces 136, 146 as the boat 100 is driven forward through the water to generate an upward force on the respective trim devices 130, 140, 150 and thus the portions of the boat 100 to which the trim devices 130, 140, 150 are attached. In their non-deployed positions, shown in FIGS. 9-11, the trim devices 130, 140, 150 are raised to a position where they do not interact (or at least only minimally interact) with the water flowing under the hull 110 of the boat 100.

Figure 2:
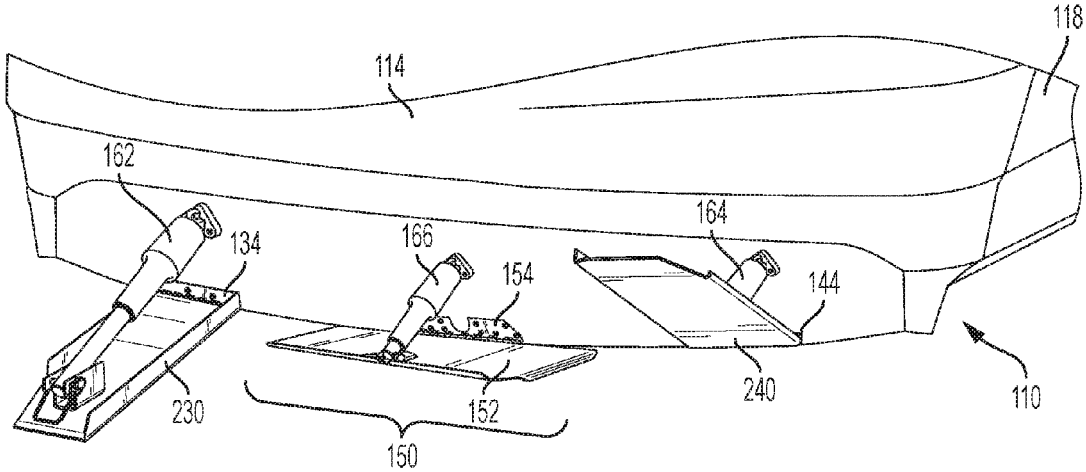
FIG. 2 shows a transom of the boat shown in FIG. 1 equipped with alternate trim devices.
Figure 3:
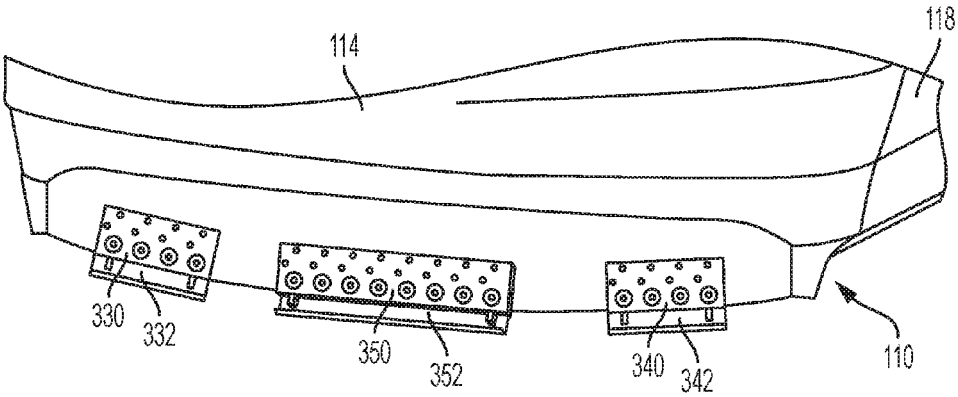
FIG. 3 shows a transom of the boat shown in FIG. 1 equipped with other alternate trim devices.

The trim devices 130, 140, 150 are not limited to the particular sizes and geometries shown in FIG. 1. Instead, trim tabs having any suitable geometry and size may be used. As shown in FIG. 2, for example, the first trim device 230 and the second trim device 240 may be flat, generally rectangular trim tabs. The trim devices are also not limited to trim tabs. Any suitable trim device may be used including, for example, interceptors. FIG. 3 shows the stern 104 of the boat 100 equipped with interceptors as the first, second, and third trim devices 330, 340, 350. These interceptors each include a blade 332, 342, 352 that is extended, preferably in a direction parallel to the transom 114 of the boat 100, below the hull 110 to intercept the water flowing under the hull 110 and generate lift on the hull 110 just forward of the blade 332, 342, 352. When the blades 332, 342, 352 are extended below the hull 110, they are positioned in the deployed position, and when the blades 332, 342, 352 are retracted, they are positioned in the non-deployed position. In other suitable embodiments, both interceptors and trim tabs can be used on the same boat 100.

II. Control System for the Boat

Figure 4:
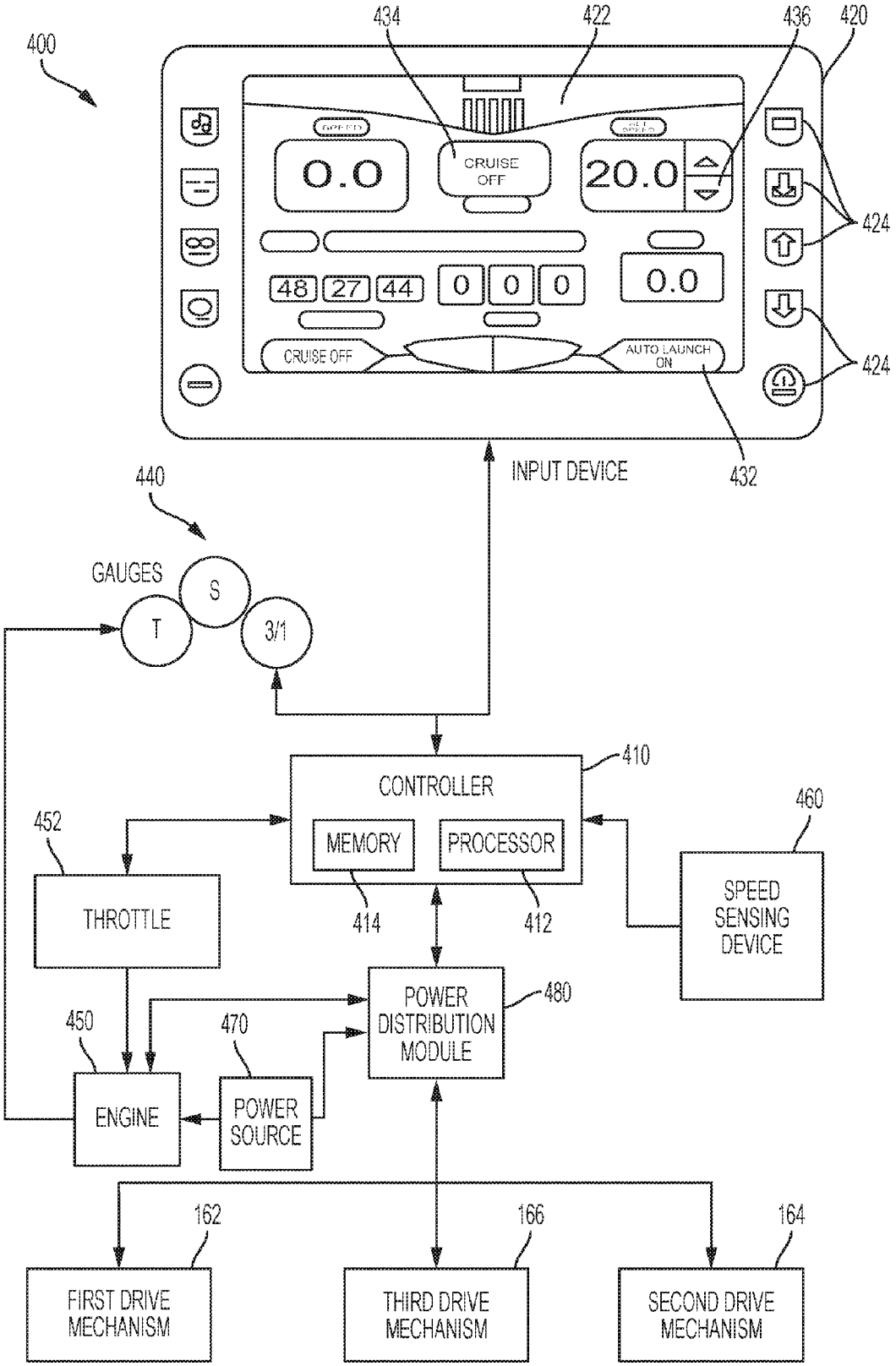
FIG. 4 is a schematic of a control system for the boat shown in FIG. 1.

FIG. 4 is a schematic diagram of the control system 400 for the boat 100 shown in FIG. 1. The same control system could be used in connection with the embodiments shown in FIGS. 2 and 3. The control system 400 includes a controller 410; an input device 420; display devices 440; an engine 450 having throttle 452; a speed sensing device 460; a power source 470; a power distribution module 480; and the first, second, and third drive mechanisms 162, 164, 166.

In this embodiment, the controller 410 is a microprocessor-based controller that includes a processor 412 for performing various functions discussed further below and a memory 414 for storing various data. The controller 410 may also be referred to as a CPU. In one embodiment, the method of getting on plane, discussed further below, may be implemented by way of a series of instructions stored in the memory 414 and executed by the processor 412.

The controller 410 is communicatively coupled to an input device 420. In this embodiment, the input device 420 includes a touch screen 422. In addition to or instead of a touch screen 422, the input device 420 may include other suitable input devices such as static buttons 424, for example. In this embodiment, the touch screen 422 may include a display with an option to activate the improved method for getting on plane. This option may be selected by tapping a portion of the touch screen 422 having a display object 432 labeled "Auto Launch." The touch screen 422 then transmits the command "Auto Launch On" to the controller 410, and the controller 410 may return various display information to indicate that the "Auto Launch" option is activated. The option may be deactivated by tapping the "Auto Launch" display object 432 again.

The touch screen 422 may also allow the user to activate cruise control for the boat 100. As with the "Auto Launch" option, the user may activate cruise control tapping a portion of the touch screen 422 having a display object 434 labeled "Cruise" and may turn off cruise control by tapping the "Cruise" display object 434 again. The user may also adjust the speed setting of the cruise control by tapping a portion of the touch screen 422 with up and down arrows 436. In each case, the touch screen 422 exchanges commands and information with the controller 410.

The controller 410 may also display various operational parameters of the boat 100 on the touch screen 422. For example, the percentage deployment of the first, second, and third trim devices 130, 140, 150, the level of the ballast tanks, and the current speed of the boat 100 may each be displayed on the touch screen 422. Operational parameters may also be displayed on other display devices 440 such as gauges.

The engine 450 is also part of the control system 400. The engine speed (RPMs) may be controlled using a throttle 452. The throttle 452 may also be communicatively coupled to the controller 410 and the controller 410 may also open and close the throttle 452, such as when the operator activates cruise control.

As will be discussed further below, the improved method of getting on plane uses the speed of the boat 100. The boat speed is provided to the controller 410 by a speed sensing device 460 that is communicatively coupled to the controller 410. Getting on plane occurs over a time duration of seconds. In some instances, the boat 100 may accelerate from zero to planing speed in as little as five seconds, and even for more heavily loaded boats, the boat 100 will typically reach planing speed in 20 seconds or less. It is therefore preferable to have a fast and accurate speed sensing device 460. In this embodiment, the speed sensing device 460 is a Global Positioning System (GPS) receiver. However, the speed sensing device 460 is not limited to a GPS receiver, and any suitable speed sensing device 460 may be used, including but not limited to a paddle wheel or a pitot tube.

In the control system embodiment shown in FIG. 4, the controller 410 operates the first, second, and third drive mechanisms 162, 164, 166 using the power distribution module 480. The power distribution module 480 receives electrical power from a power source 470 and then transmits power to various components on the boat 100. When the improved method of getting on plane is activated, the controller 410 sends instructions to the power distribution module 480 instructing the power distribution module 480 to provide power or stop providing power to the first, second, and third drive mechanisms 162, 164, 166, in order to move the first, second, and third trim devices 130, 140, 150 between the deployed and non-deployed positions.

III. Improved Method of Getting on Plane

In general, getting on plane is improved when all three trim devices 130, 140, 150 are deployed and then individually retracted as the boat 100 approaches planing speed. This method will now be described in more detail with reference to the flow charts shown in FIGS. 5A and 5B.

When an operator desires to activate this improved method for getting on plane, the operator provides a command through the input device 420, for example, by tapping the "Auto Launch" display object 432. Preferably, this occurs before or shortly after the operator begins to accelerate the boat. The controller 410 receives the "Auto Launch On" command from the input device 420 in step S505. In step S510, the first, second, and third trim devices 130, 140, 150 are moved to their deployed positions (to the extent they are not already in their deployed positions). To move the first, second, and third trim devices 130, 140, 150, the controller 410 sends a signal to the power distribution module 480, and the power distribution module 480 in turn provides power to each drive mechanism 162, 164, 166.

For the embodiment shown in FIG. 1, the positions of the first, second, and third trim devices 130, 140, 150 after step 5510 are shown in FIGS. 6, 7, and 8, respectively. FIG. 6 is a port side view of the boat 100 with the first trim device 130 in the deployed position with a downward angle α. FIG. 7 is a starboard side view of the boat 100 with the second trim device 140 in the deployed position with a downward angle β. FIG. 8 is a cross-section view of the boat 100 (taken along section line 8-8 in FIG. 1) with the third trim device 150 in the deployed position with a downward angle γ.

The optimal deployed position of each trim device 130, 140, 150 will vary based on a number of factors including the weight of the boat 100 and the size and type of trim device used. With trim tabs, for example, the lift is generally proportional to the surface area of the tab that is deployed into the water flow under the hull 110 of the boat 100. Thus, the first and second trim devices 130, 140 shown in FIG. 1 would generate more lift than the first and second trim devices 230, 240 shown in FIG. 2 for the same downward angle α, β, γ. The amount of upward force produced by the deployed trim devices 130, 140, 150 may be tailored by individually adjusting the amount of deployment of each trim device 130, 140, 150. For example, the trim devices 130, 140, 150 may be used to help control the roll of the boat 100, such as from propeller torque, as the boat 100 accelerates to planing speed.

In this embodiment, the deployment angle of at least one trim device, such as the deployment angle γ of the third trim device 150, may be different than the deployment angles of the other trim devices, such as the deployment angles α, β of the first and second trim devices 130, 140. Deployment angles α, β, γ may be expressed as a percentage. This percentage may correlate to the stroke length of the drive mechanism 162, 164, 166. Thus, in this embodiment, for example, the first and second trim devices 130, 140, may each be deployed to 60 percent, but the third device 150 may be fully deployed (100 percent). The deployment angles α, β of the first and second trim devices 130, 140 are the same in this example, and the deployment angle γ of the third trim device 150 is larger than the deployment angles α, β of the first and second trim devices 130, 140.

The lift produced by the trim devices 130, 140, 150 is desirably used to decrease the running angle of attack. The inventors have found, however, that keeping the full amount of deployment of all trim devices 130, 140, 150, and resultant lift, through the full range of acceleration to planing can result in the bow 112 dropping when the boat 100 reaches planing speed. When this occurs, water may spray and flow over the bow 112 of the boat 100 as drag is increased due to the trim devices 130, 140, 150 being deployed.

The inventors have found that individually retracting the deployed trim devices 130, 140, 150 as the boat 100 approaches planing speed improves the ability of the boat 100 to get on plane and can prevent the bow 112 of the boat 100 from dropping suddenly when the boat 100 begins to the plane. As a result, spray and water flowing over the bow 112 can be avoided, as can any increased drag resulting from the deployed trim devices 130, 140, 150 at planing speed.

Figure 5A:
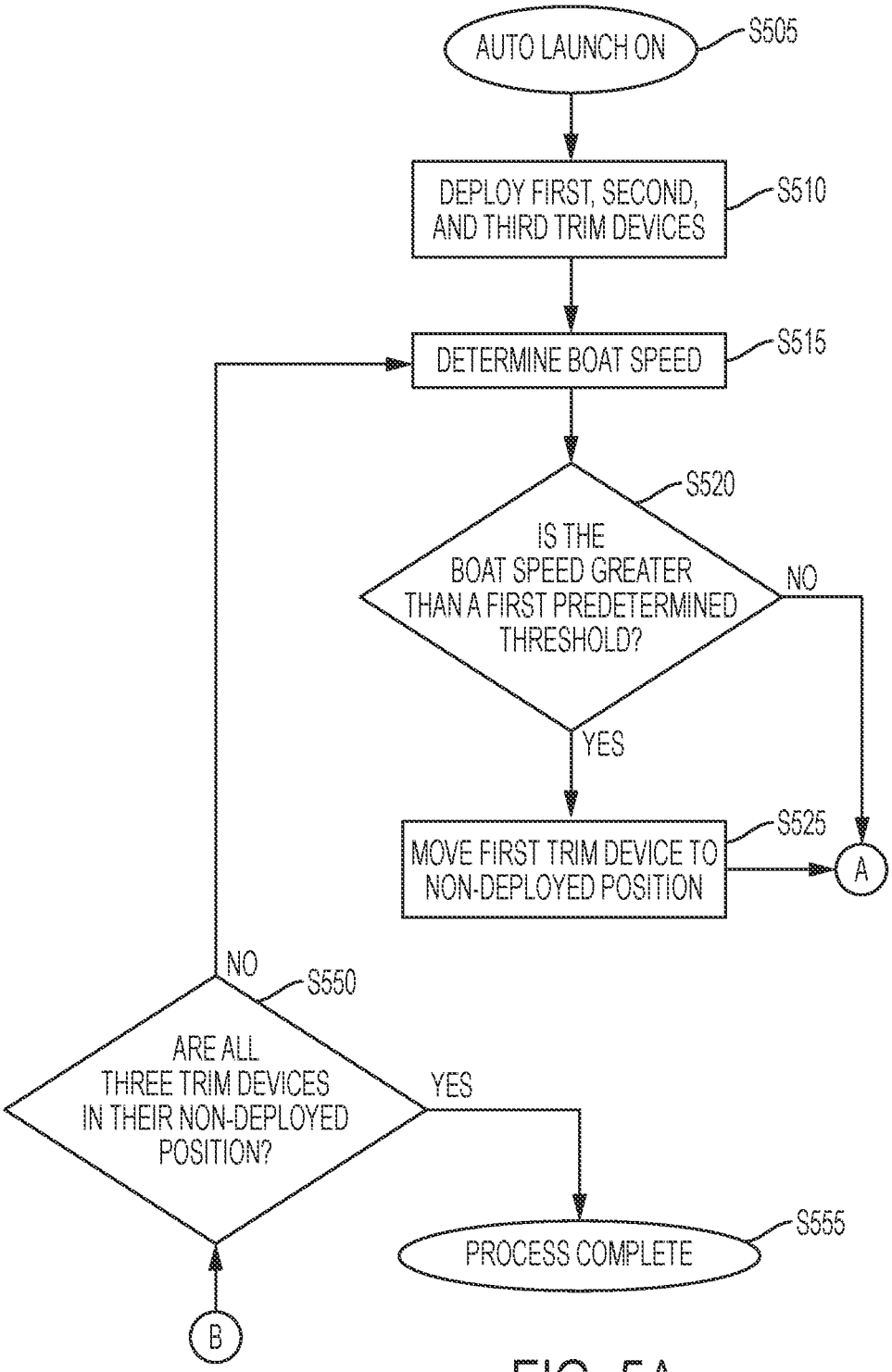
FIGS. 5A and 5B are flow charts depicting an improved method of getting a boat, such as the one shown in FIG. 1, on plane.
Figure 5B:
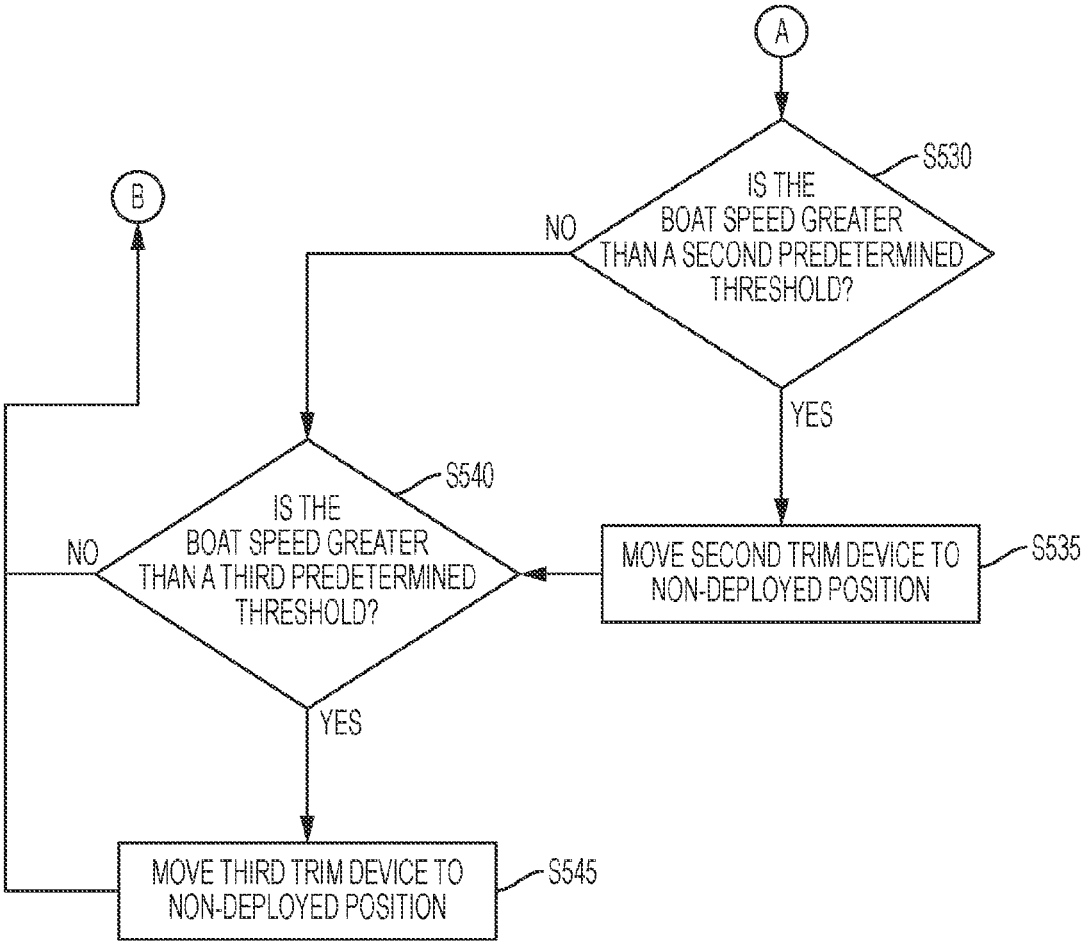

The inventors have found that an effective way to control when the deployed trim devices 130, 140, 150 are individually retracted is based on speed. The speed at which a trim device 130, 140, 150 is retracted is referred to as the crossover speed. As shown in FIG. 5A, the controller 410 receives the speed of the boat 100 from the speed sensing device 460 in step S515. The controller 410 then checks the speed against a first predetermined threshold (crossover speed) in step S520. When the speed of the boat 100 is greater than the first predetermined threshold, the first trim device 130 is retracted.

Figure 9:
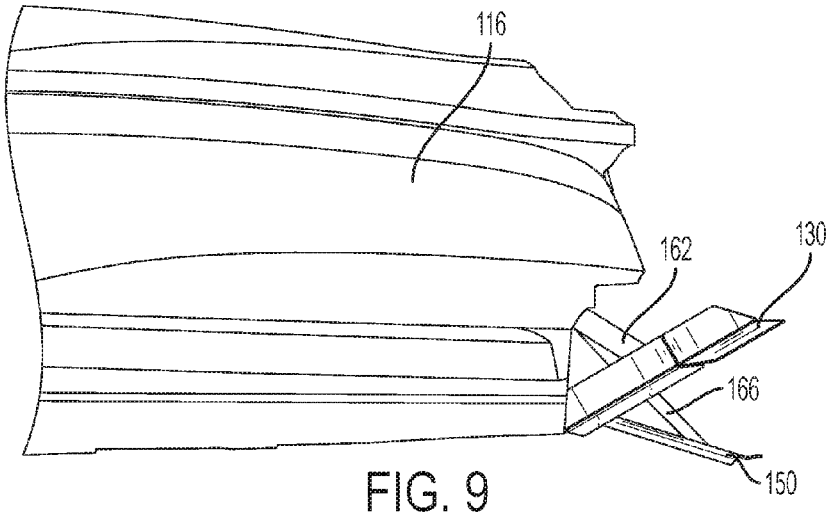
FIG. 9 is a port side view of the boat shown in FIG. 1 after step S525 FIG. 5A.

If the first trim device 130 is in its deployed position, the controller 410 moves the first trim device 130 to its non-deployed position in step S525 by sending a signal to the power distribution module 480. The power distribution module 480 then provides power to the first drive mechanism 162 to move the first trim device 130 to the non-deployed position. FIG. 9 is a port side view of the boat 100 with the first trim device 130 in the non-deployed position after step S525. Once the first trim device 130 is in its non-deployed position, the process moves to step S530 (shown in FIG. 5B). The process also moves to step S530 when the speed of the boat 100 is less than the first predetermined threshold (step S520).

Figure 10:
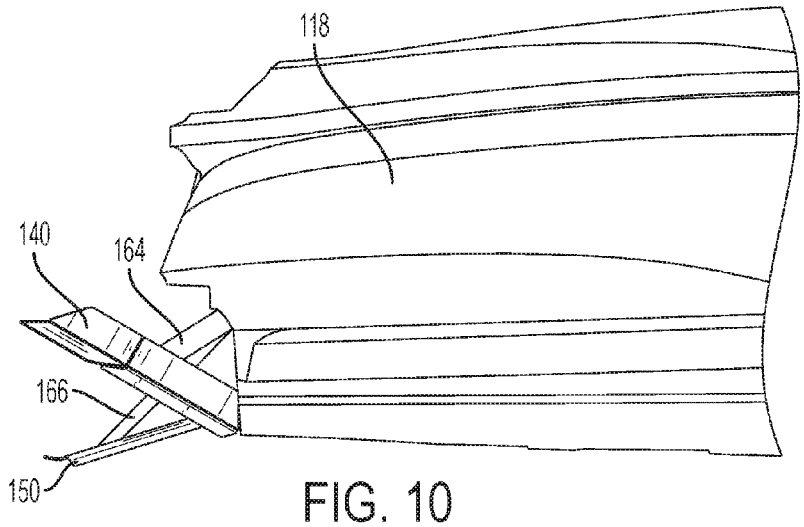
FIG. 10 is a starboard side view of the boat shown in FIG. 1 after step S535 in FIG. 5B.

In step S530 the controller 410 checks the speed against a second predetermined threshold. When the speed of the boat 100 is greater than the second predetermined threshold, the second trim device 140 is retracted. In step S535, the controller 410 moves the second trim device 140 to its non-deployed position, if it is not already there. FIG. 10 is a starboard side view of the boat 100 with the second trim device 140 in the non-deployed position after step S535. The process moves to step S540 after the second trim device 140 is in its non-deployed position. If the speed of the boat 100 is less than the second predetermined threshold (step S530), the process also moves to step S540.

Figure 11:
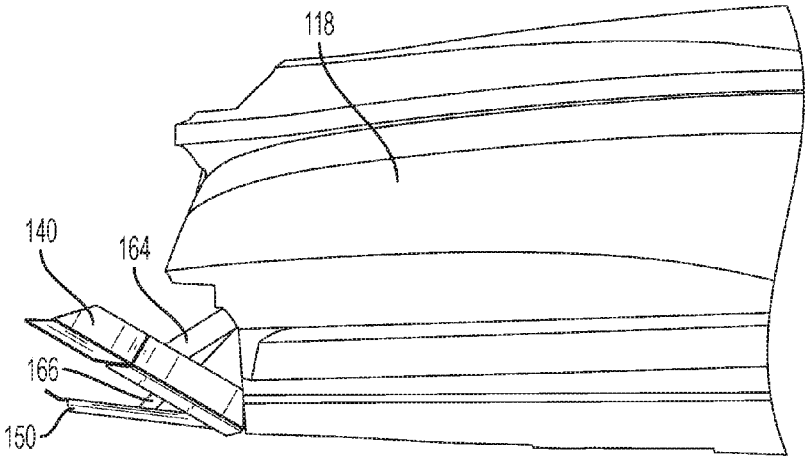
FIG. 11 is a starboard side view of the boat shown in FIG. 1 after step S545 in FIG. 5B.

In step S540 the controller 410 checks the speed of the boat 100 against a third predetermined threshold. When the speed of the boat 100 is greater than the third predetermined threshold, the third trim device 150 is retracted. In step S545, the controller 410 moves the third trim device 150 to its non-deployed position, if it is not already there. FIG. 11 is a starboard side view of the boat 100 with the third trim device 150 in the non-deployed position after step S545. The process moves to step S550 (shown in FIG. 5A) after the third trim device 150 is in its non-deployed position. If the speed of the boat 100 is less than the third predetermined threshold (step S540), the process also moves to step S550.

In step S550, the controller 410 checks if all of the trim devices 130, 140, 150 are in their non-deployed position. If not, the process returns to step S515 to continue to monitor the speed of the boat 100 and retract the trim devices 130, 140, 150 as described above. If all of the trim devices 130, 140, 150 have been retracted to their non-deployed positions, the process terminates in step S555.

To achieve the advantages of this invention, each of the first, second, and third predetermined thresholds are preferably less than the boat's planing speed. More preferably, the maximum speed for each of the first, second and third predetermined thresholds is less than or equal to 22 mph. Preferably, the trim devices 130, 140, 150 are all deployed long enough to provide some lift benefit in achieving planing, and each of the first, second, and third predetermined thresholds is preferably greater than or equal to 14 mph. Each of the first, second, and third predetermined thresholds (crossover speeds) may be individually controlled. For example, the third predetermined threshold may be set either higher or lower than the first and second predetermined thresholds.

While each predetermined threshold may be set to different crossover speeds, they may also be set to be the same crossover speed. In some instances it may be advantageous for two of the three predetermined thresholds to be the same, such as the first and second predetermined threshold, for example. With the first and second predetermined threshold set to the same crossover speed, the third predetermined threshold is preferably set at a higher speed than the first and second predetermined thresholds. Here, the first and second predetermined thresholds are preferably greater than or equal to 14 mph and less than or equal to 18 mph, and the third predetermined threshold is greater than or equal to 18 mph and less than or equal to 22 mph. The third predetermined threshold, however, may also be set to be lower speed than the first and second predetermined thresholds.

IV. Computer Implementation

Various features of the example embodiments described herein may be implemented using hardware, software, or a combination thereof and may be implemented in one or more computer systems or other processing systems. However, the manipulations performed in these embodiments were often referred to in terms, such as determining, which are commonly associated with mental operations performed by a human operator. No such capability of a human operator is necessary in any of the operations described herein. Rather, the operations may be completely implemented with machine operations. Useful machines for performing the operation of the exemplary embodiments presented herein include general purpose digital computers or similar devices.

From a hardware standpoint, a CPU typically includes one or more components, such as one or more microprocessors for performing the arithmetic and/or logical operations required for program execution, and storage media, such as one or more disk drives or memory cards (e.g., flash memory) for program and data storage, and a random access memory for temporary data and program instruction storage. From a software standpoint, a CPU typically includes software resident on a storage media (e.g., a disk drive or memory card), which, when executed, directs the CPU in performing transmission and reception functions. The CPU software may run on an operating system stored on the storage media, such as, for example, UNIX or Windows (e.g., NT, XP, Vista), Linux, and the like, and can adhere to various protocols such as the Ethernet, ATM, TCP/IP, CAN, LIN protocols and/or other connection or connectionless protocols. As is well known in the art, CPUs can run different operating systems, and can contain different types of software, each type devoted to a different function, such as handling and managing data/information from a particular source, or transforming data/information from one format into another format. It should thus be clear that the embodiments described herein are not to be construed as being limited for use with any particular type of server computer, and that any other suitable type of device for facilitating the exchange and storage of information may be employed instead.

A CPU may be a single CPU, or may include multiple separate CPUs, wherein each is dedicated to a separate application, such as, for example, a data application, a voice application, and a video application. Software embodiments of the example embodiments presented herein may be provided as a computer program product, or software, that may include an article of manufacture on a machine-accessible or non-transitory computer-readable medium (i.e., also referred to as "machine readable medium") having instructions. The instructions on the machine-accessible or machine-readable medium may be used to program a computer system or other electronic device. The machine-readable medium may include, but is not limited to, floppy diskettes, optical disks, CD-ROMs, magneto-optical disks, USB thumb drives, and SD cards or other type of media/machine-readable medium suitable for storing or transmitting electronic instructions. The techniques described herein are not limited to any particular software configuration. They may find applicability in any computing or processing environment. The terms "machine-accessible medium," "machine-readable medium," and "computer-readable medium" used herein shall include any non-transitory medium that is capable of storing, encoding, or transmitting a sequence of instructions for execution by the machine (e.g., a CPU or other type of processing device) and that cause the machine to perform any one of the methods described herein.

Furthermore, it is common in the art to speak of software, in one form or another (e.g., program, procedure, process, application, module, unit, logic, and so on) as taking an action or causing a result. Such expressions are merely a shorthand way of stating that the execution of the software by a processing system causes the processor to perform an action to produce a result.

The embodiments discussed herein are examples of preferred embodiments of the present invention and are provided for illustrative purposes only. They are not intended to limit the scope of the invention. Although specific configurations, structures, etc. have been shown and described, such are not limiting. Modifications and variations are contemplated within the scope of the invention, which is to be limited only by the scope of the accompanying claims.

What is claimed is:

1. A boat comprising:

a hull including a bow, a transom, and port and starboard sides;

at least three trim devices positioned aft of the transom, a first one of the trim devices being a port-side trim device provided on a port side of the boat's centerline, a second one of the trim devices being a starboard-side trim device provided on a starboard side of the boat's centerline, and a third one of the trim devices being an intermediate trim device provided between the port-side and the starboard-side trim devices, each of the at least three trim devices being (i) one of a trim tab and an interceptor and (ii) moveable between a deployed position in which at least a portion of the respective trim device is positioned below the hull and a non-deployed position position in which the portion of the respective trim device that is positioned below the hull in the deployed position is higher than it is in the deployed position;

a plurality of drive mechanisms, each drive mechanism configured to move a corresponding trim device between the deployed position and the non-deployed position;

a speed sensing device configured to determine the speed of the boat; and a controller configured to:

actuate the plurality drive mechanisms to move each of the at least three trim devices to the deployed position;

receive the speed of the boat from the speed sensing device;

determine when the speed of the boat exceeds a first predetermined threshold;

actuate the drive mechanism corresponding to the port-side trim device to move the port-side trim device from the deployed position to the non-deployed position when the speed of the boat exceeds the first predetermined threshold;

determine when the speed of the boat exceeds a second predetermined threshold;

actuate the drive mechanism corresponding to the starboard-side trim device to move the starboard-side trim device from the deployed position to the non-deployed position when the speed of the boat exceeds the second predetermined threshold;

determine when the speed of the boat exceeds a third predetermined threshold; and actuate the drive mechanism corresponding to the intermediate trim device to move the intermediate trim device from the deployed position to the non-deployed position when the speed of the boat exceeds the third predetermined threshold, wherein at least one of the first, second, and third predetermined thresholds is different from the other two of the first, second, and third predetermined thresholds.

2. The boat of claim 1, wherein the first predetermined threshold and the second predetermined threshold are the same.

3. The boat of claim 1, wherein the third predetermined threshold is greater than the first and second predetermined thresholds.

4. The boat of claim 1, wherein the third predetermined threshold is less than the first and second predetermined thresholds.

5. The boat of claim 1, wherein the first predetermined threshold is between about 14 miles per hour and about 22 miles per hour.

6. The boat of claim 1, wherein the first predetermined threshold is between about 14 miles per hour and about 18 miles per hour.

7. The boat of claim 1, wherein the second predetermined threshold is between about 14 miles per hour and about 22 miles per hour.

8. The boat of claim 1, wherein the second predetermined threshold is between about 14 miles per hour and about 18 miles per hour.

9. The boat of claim 1, wherein the third predetermined threshold is between about 14 miles per hour and about 22 miles per hour.

10. The boat of claim 1, wherein the third predetermined threshold is between about 18 miles per hour and about 22 miles per hour.

11. The boat of claim 1, wherein the at least three trim devices are trim tabs.

12. The boat of claim 11, wherein each of the trim devices extends at a downward angle in the deployed position and the downward angle of at least one of the port-side, the starboard-side, and the intermediate trim devices in the deployed position is different from the downward angles of the other two of the port-side, the starboard-side, and the intermediate trim devices in the deployed position.

13. The boat of claim 12, wherein the downward angle of the intermediate trim device in the deployed position is larger than the downward angles of the port-side and the starboard-side trim devices in the deployed position.

14. The boat of claim 12, wherein the downward angle of the port-side trim device in the deployed position is the same as the downward angle of the starboard-side trim device in the deployed position.

15. The boat of claim 1, wherein the at least three trim devices are interceptors.

16. The boat of claim 15, wherein each of the interceptors includes a blade that extends a distance below the hull in the deployed position and the distance that the blade of at least one of the port-side, the starboard-side, and the intermediate trim devices extends below the hull in the deployed position is different from the distance that the blades of the other two of the port-side, the starboard-side, and the intermediate trim devices extend below the hull in the deployed position.

17. The boat of claim 16, wherein the distance that the blade of the intermediate trim device extends below the hull in the deployed position is greater than the distance that the blades of the port-side and the starboard-side trim devices extend below the hull in the deployed position.

18. The boat of claim 16, wherein the distance that the blade of the port-side trim device extends below the hull in the deployed position is the same as the distance that the blade of the starboard-side trim device extends below the hull in the deployed position.

19. The boat of claim 1, wherein the speed sensing device includes at least one of a global positioning system receiver, a paddle wheel, and a pitot tube.

20. The boat of claim 1, wherein each of the plurality of drive mechanisms is at least one of a linear actuator, hydraulic actuator, and a gas assist pneumatic actuator.

21. The boat of claim 1, wherein each of the plurality of drive mechanisms is an electric motor.

22. A method of operating a boat, the method comprising:

deploying each of at least three trim devices to a deployed position, a first one of the trim devices being a port-side trim device provided on a port side of the boat's centerline, a second one of the trim devices being a starboard-side trim device provided on a starboard side of the boat's centerline, and a third one of the trim devices being an intermediate trim device provided between the port-side and the starboard-side trim devices, the deployed position being a position in which at least a portion of the respective trim device is below the hull of the boat such that water flowing under the hull impinges on the respective trim device and creates an upward force on the boat as the boat moves through the water;

determining the speed of the boat;

moving the port-side trim device from the deployed position to a non-deployed position when the speed of the boat exceeds a first predetermined threshold, the non-deployed position being a position in which the portion of the port-side trim device that is below the hull in the deployed position is higher than it is in the deployed position;

moving the starboard-side trim device from the deployed position to a non-deployed position when the speed of the boat exceeds a second predetermined threshold, the non-deployed position being a position in which the portion of the starboard-side trim device that is below the hull in the deployed position is higher than it is in the deployed position; and moving the intermediate trim device from the deployed position to a non-deployed position when the speed of the boat exceeds a third predetermined threshold, the non-deployed position being a position in which the portion of the intermediate trim device that is below the hull in the deployed position is higher than it is in the deployed position, wherein at least one of the first, second, and third predetermined thresholds is different from the other two of the first, second, and third predetermined thresholds.

23. The method of claim 22, wherein the first predetermined threshold and the second predetermined threshold are the same.

24. The method of claim 22, wherein the third predetermined threshold is greater than the first and second predetermined thresholds.

25. The method of claim 22, wherein the third predetermined threshold is less than the first and second predetermined thresholds.

26. The method of claim 22, wherein the first predetermined threshold is between about 14 miles per hour and about 22 miles per hour.

27. The method of claim 22, wherein the first predetermined threshold is between about 14 miles per hour and about 18 miles per hour.

28. The method of claim 22, wherein the second predetermined threshold is between about 14 miles per hour and about 22 miles per hour.

29. The method of claim 22, wherein the second predetermined threshold is between about 14 miles per hour and about 18 miles per hour.

30. The method of claim 22, wherein the third predetermined threshold is between about 14 miles per hour and about 22 miles per hour.

31. The method of claim 22, wherein the third predetermined threshold is between about 18 miles per hour and about 20 miles per hour.

32. The method of claim 22, wherein the at least three trim devices are trim tabs.

33. The method of claim 32, wherein deploying each of the trim devices includes moving each of the trim devices to a downward angle in the deployed position, the downward angle of at least one of the port-side, the starboard-side, and the intermediate trim devices in the deployed position being different from the downward angles of the other two of the port-side, the starboard-side, and the intermediate trim devices in the deployed position.

34. The method of claim 33, wherein the downward angle of the intermediate trim device in the deployed position is larger than the downward angles of the port-side and the starboard-side trim devices in the deployed position.

35. The method of claim 33, wherein the downward angle of the port-side trim device in the deployed position is the same as the downward angle of the starboard-side trim device in the deployed position.

36. The method of claim 22, wherein the at least three trim devices are interceptors.

37. The method of claim 36, wherein each of the interceptors includes a blade and deploying each of the trim devices includes extending the blade of each trim device a distance below the hull in the deployed position, the distance that the blade of at least one of the port-side, the starboard-side, and the intermediate trim devices extends below the hull in the deployed position being different from the distance that the blades of the other two of the port-side, the starboard-side, and the intermediate trim devices extend below the hull in the deployed position.

38. The method of claim 37, wherein the distance that the blade of the intermediate trim device extends below the hull in the deployed position is greater than the distance that the blades of the port-side and the starboard-side trim devices extend below the hull in the deployed position.

39. The method of claim 37, wherein the distance that the blade of the port-side trim device extends below the hull in the deployed position is the same as the distance that the blade of the starboard-side trim device extends below the hull in the deployed position.

40. A non-transitory computer readable storage medium having stored thereon sequences of instruction for executing the method of claim 22.

41. The boat of claim 11, wherein each of the trim tabs includes a plate-like member and at least one downturned surface angled at a downward angle relative to the plate-like member.

* * * * *